United States Patent [19]

Collin

[11] 4,418,511

[45] Dec. 6, 1983

[54] APPARATUS AND METHOD FOR FILM PACKAGING

[75] Inventor: Everett E. Collin, Gray Court, S.C.

[73] Assignee: Nordson Corporation, Amherst, Ohio

[21] Appl. No.: 159,365

[22] Filed: Jun. 13, 1980

[51] Int. Cl.[3] ..... B65B 11/52; B65B 61/28

[52] U.S. Cl. ..... 53/427; 53/509; 264/553; 271/195; 425/388

[58] Field of Search ..... 53/427, 432, 433, 509, 53/510, 511; 264/553; 425/388, 504, DIG. 48; 271/97, 195, 132; 198/721; 414/676

[56] References Cited

U.S. PATENT DOCUMENTS

| | | | |
|---|---|---|---|
| 868,317 | 10/1907 | Allen | 271/97 X |
| 2,976,658 | 3/1961 | Kostur | 53/509 |
| 2,984,364 | 5/1961 | Lamb | 414/676 |
| 3,052,339 | 9/1962 | Carter | 198/721 X |
| 3,377,770 | 4/1968 | Rorer | 53/509 |
| 3,387,426 | 6/1968 | Kraut et al. | 53/427 |
| 3,501,886 | 3/1970 | Watts et al. | 53/509 X |
| 3,512,335 | 5/1970 | Rorer | 53/509 |
| 3,553,931 | 1/1971 | Rorer | 53/509 |
| 3,583,129 | 6/1971 | Rorer | 53/509 |
| 3,945,172 | 3/1976 | Johnson | 53/509 |
| 4,114,758 | 9/1978 | Coleman | 53/433 X |
| 4,188,770 | 2/1980 | Tabur | 53/509 |

OTHER PUBLICATIONS

U.S. Packaging Corp. Drawing No. AC-039-0843, Rev. A, 9/8/78.

Blueprint CT-3036, "Vacuum Box Discharge Pusher".

*Primary Examiner*—Nicholas P. Godici

*Assistant Examiner*—Charles L. Willis

*Attorney, Agent, or Firm*—Watts, Hoffman, Fisher & Heinke

[57] ABSTRACT

A film packaging machine 20 has a vacuum platen 28 with a slidable air-permeable discharge plate 72 that is driven by air cylinders 112, 114 within the platen to eject a finished package by moving a leading edge of the package off the platen and into pinch rolls 62. A small plenum 96 beneath the platen surface at the discharge end, extending across the width of the platen, is supplied with air under pressure to relieve the vacuum beneath the leading portion of the package to facilitate ejection.

17 Claims, 14 Drawing Figures

APPARATUS AND METHOD FOR FILM PACKAGING

DESCRIPTION

1. Technical Field

This invention relates to film (or so-called "skin") packaging and particularly to vacuum platens and to mechanisms and methods for discharging packages from vacuum platens.

2. Background Art

Film packages are typically formed on a vacuum platen that supports a card-like air-permeable panel on which an article to be packaged rests. Air is evacuated through the platen to draw a heat-softened plastic film into conformance with the article and panel to adhere the film. An effective way of heating and applying the film is to grip it in a vertically movable horizontal frame, raise the frame to an overhead oven to soften the film and then lower the frame and film to the card and article on the platen.

Removal of film packages from vacuum platens of known film packaging machines has typically been accomplished by either lifting the package manually, or by first relieving the vacuum with a reverse flow of air to the platen and use of suitable mechanisms that grasp a corner or edge of the card-like package and pull the package from the platen, or by providing a conveyor roll system as a part of the vacuum box and on which the package rests and conveying the package from the platen by driving the rolls. Pusher mechanisms have also been used.

Manual systems require expensive labor to operate and automatic systems, such as those that grip the packages or that use conveyor rolls, are typically cumbersome and expensive. Also, where the driving mechanism is outside but operates through the vacuum platen, air leakage becomes a problem. Conveyor roller systems in the platen are usually unsatisfactory, except where heavy articles are packaged, due to lack of roller traction. Pushers tend to buckle the panel or card forming the package on the platen and sometimes move or push askew from the desired path.

DISCLOSURE OF INVENTION

The present invention provides a film packaging machine with a vacuum platen and package discharge mechanism that overcomes the above disadvantages and others. The apparatus is effective, economical and compact. It is designed for use in forming a conventional film package, which typically comprises an air-permeable panel, such as a card, for supporting one or more products, and a thermoplastic film, such as polyethylene, that is heated and drawn over the products and adhered to the panel. The panel may provide a thermoplastic adhesive on the upper surface.

The apparatus comprises a box-like vacuum platen and pinch rolls adjacent a discharge edge of the platen. An air-permeable discharge plate covers a major portion but not all of the platen and slides over the platen surface on inset runners. The movement is guided to maintain proper direction. The plate has a trailing abutment for engaging the back edge of a package panel that is located on the platen during the formation of a film package. The plate underlies and supports a major portion of the package panel, including the trailing end but not the leading end. A front edge of the plate is spaced from a discharge end of the platen by a distance substantially equal to the travel of the plate as it slides over the platen surface. Movement of the plate from the rear position, where it is located during package formation, and the forward position to which it is moved to discharge a finished package, carries the formed film package to advance the leading edge of the package off the platen and into the bite of the pinch rolls. Operation of the pinch rolls serves to then convey the finished package from the platen.

Movement of the discharge plate and formed package is facilitated by a blow-off structure comprised of a small plenum located beneath the platen surface and elongated transversely of the path of package travel, so the plenum extends beneath and adjacent the front edge of a package on the platen. The plenum is isolated from a vacuum chamber that underlies the platen surface, and communicates to a source of air under pressure through a solenoid-actuated valve. Thus, operation of the valve results in a flow of air under pressure to an isolated location beneath the leading edge of the package panel to break the vacuum that exists upon completion of the packaging operation. This is necessary to facilitate discharge of the package from the platen. Isolation of positive pressure to the area directly beneath the leading edge of the package rather than pressurizing the entire vacuum platen throughout has proved to be adequate, especially in conjunction with the use of a discharge plate that supports or carries a major portion of the package. By virtue of the support, the plate can move the package much more readily than the package panel could be slid along the surface in the presence of a partial vacuum. Thus, only a relatively small air flow under positive pressure is required to permit discharge of the finished package.

The discharge plate is moved by a reciprocating drive within the platen, communicating to the plate only through the top surface of the platen. This avoids the need for seals to abut or surround moving rods or other drive mechanisms that otherwise pass through the vacuum box. In addition, the drive arrangement being so located provides a compact and efficient platen unit. Advantageously, two double-acting air cylinders are located within the vacuum platen beneath the top platen surface and are oriented parallel to the direction of discharge plate movement. Ends of the cylinder piston rods are attached to the bottom surface of the plate along each longitudinal side edge that extends in the direction of plate travel. Air supply and exhaust conduits communicate to the air cylinders through the vacuum box. The stroke of the air cylinders is sufficient to move the leading edge of the support plate from the rear position at which it is spaced from the front of the platen, to a forward position at the front of the platen. In the preferred embodiment this stroke is slightly longer than the distance between the leading edge of the packaging panel and the point of tangency between the pinch rolls. Ideally, the platen corresponds in length and width to the dimensions of the packaging panel, so the front of the package is advanced from the platen, upon movement of the plate, the same distance that the plate moves, and hence into the bite of the pinch rolls, which are spaced from the platen a distance corresponding to the movement of the plate. Alternatively, if the panel forming the package is smaller than the platen, the panel is placed at the front edge of the platen and an abutment is placed forward of the trailing edge of the support plate or a spacer is placed between the trailing abutment and the back edge of the package panel, so the forward edge of the panel is still moved a distance corresponding to the movement of the plate and into the rolls.

The above and other features and advantages of the invention will become better understood from the detailed description that follows, when considered in connection with the accompanying drawings.

BEST MODE FOR CARRYING OUT THE INVENTION

Figure 1:
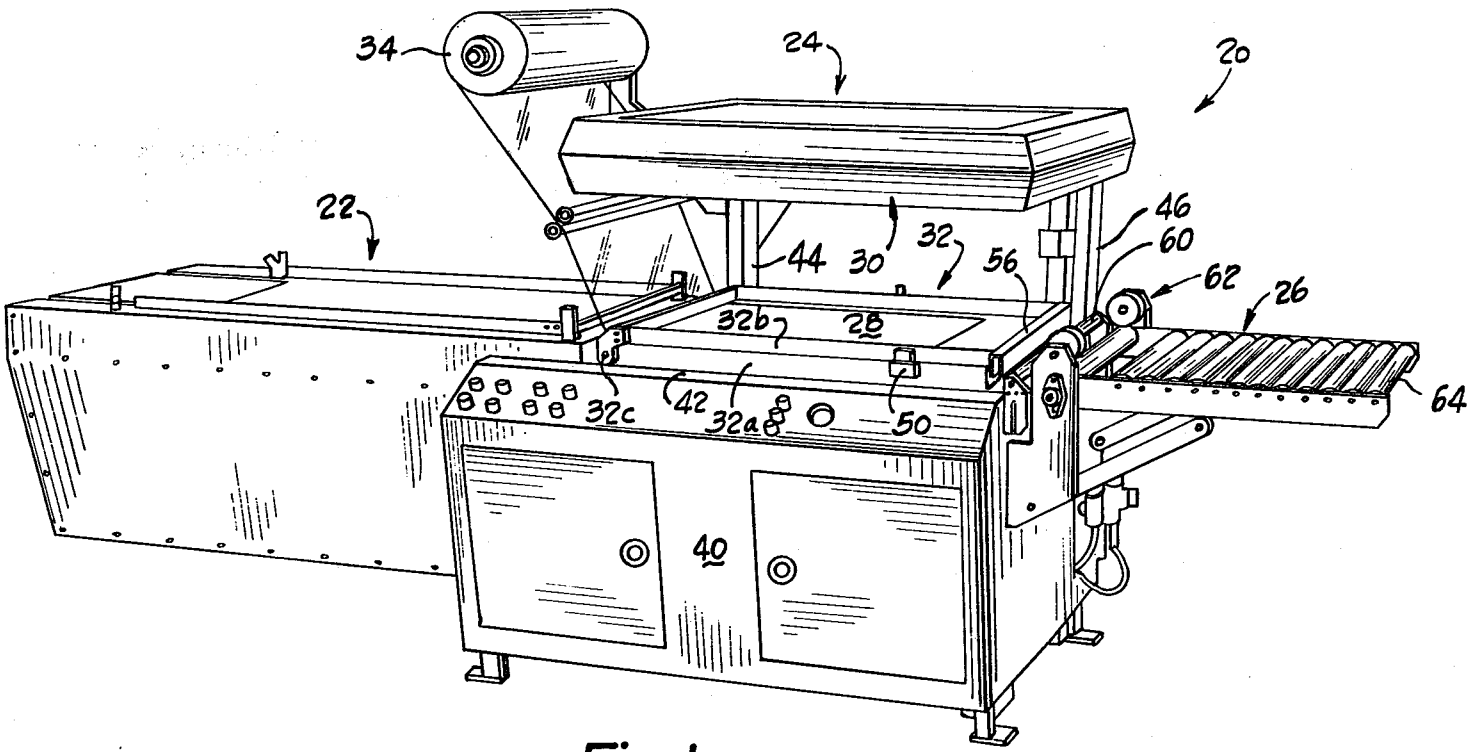
FIG. 1 is a perspective view of a film packaging machine embodying the present invention.

A film packaging machine 20 embodying the present invention is shown in FIG. 1 and includes a loading table 22, package forming apparatus 24, and a take-off conveyor 26. The package-forming apparatus 24 includes a vacuum platen 28 aligned in a common horizontal plane with the loading table 22 and take-off conveyor 26, an oven or heater 30 above the platen, and a film frame 32 moveable vertically between the oven and platen. A roll of packaging film 34, such as polyethylene or the like, is supported adjacent the package-forming apparatus 24 for supplying film to the frame for packaging.

In use, a package-forming panel, such as a rectangular sheet of air-permeable card stock or the like, is placed on the loading table 22 and a plurality of products to be packaged are placed on the panel at spaced locations. After packaging, the panel will typically be die cut to provide separate individual packages from the plurality that are concurrently formed on the single panel. Film from the roll 34 extends through the frame 32 and is gripped by the frame. The frame is raised to place the film adjacent the oven and heat from the oven softens the film. The panel is fed from the loading table 22 onto the vacuum platen 28 while the frame is in the raised position. After the film has been sufficiently heated, and softened, the frame is lowered to the position shown in FIG. 1 and a vacuum is drawn in the platen 28, through the panel, to evacuate air from beneath the film, which then closely conforms to the product and adheres to the panel. The package is then cooled, the vacuum is released, and the package is moved from the platen onto the take-off conveyor 26.

With reference to the package-forming apparatus 24, a cabinet-like base 40 has a flat support surface 42 on which the vacuum platen 28 is supported. The oven 30 is cantilevered in a horizontal orientation above the vacuum platen 28 on horizontally spaced vertical oven support posts 44, 46 at the back of the base 40. Louvers (not shown) form a part of the oven and can be actuated to adjust their position to control the heat emitted from the oven. The vertical location of the oven above the platen can be adjusted manually.

Figure 2:
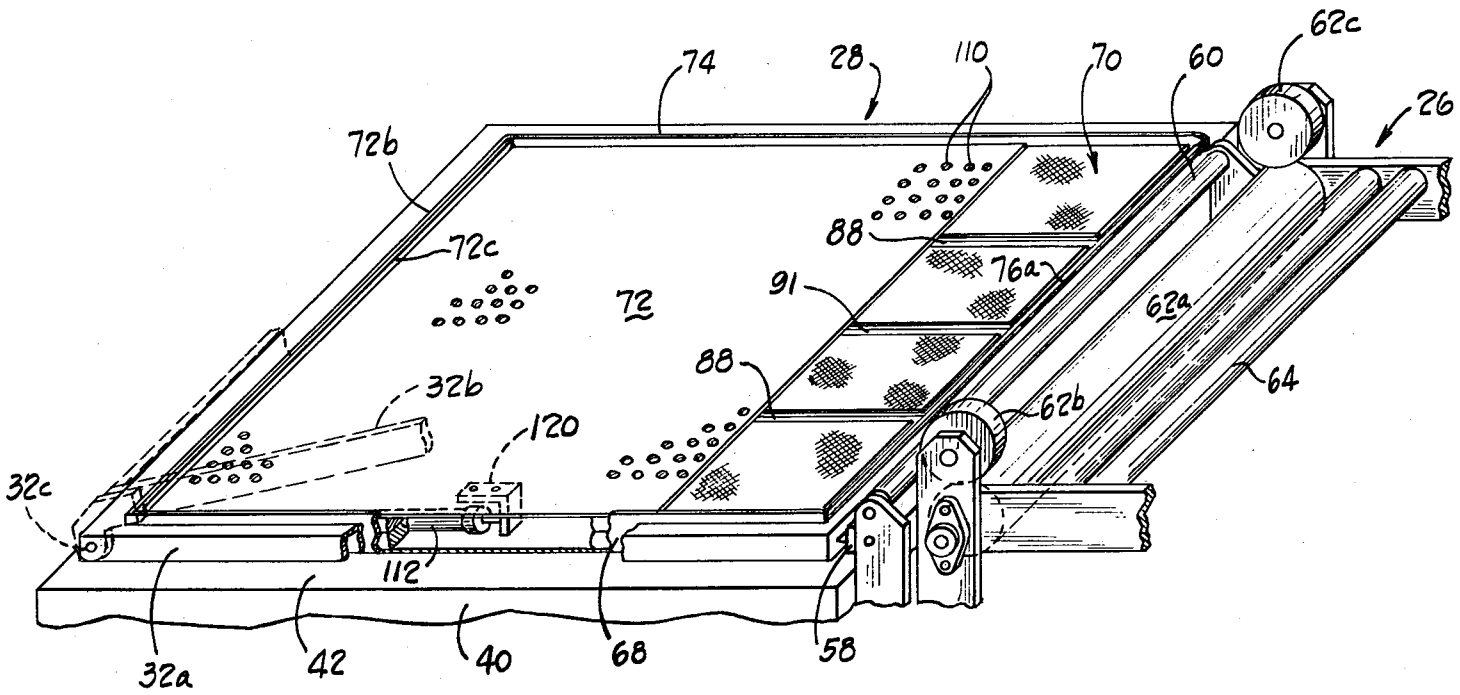
FIG. 2 is an isometric partial view of the machine of FIG. 1 showing the vacuum platen.

The film frame 32, as shown in FIGS. 1 and 2, has a lower rectangular frame member **32*a* and upper rectangular frame member 32*b* connected together at a pivot 32*c* along one end adjacent the loading table. Film 34 extends between the upper and lower frame members and is clamped between them when the upper member is closed against the lower member as shown in FIG. 1. The upper frame member is held in a clamping position by an electromagnet 50. The upper frame member is raised in a pivoting motion about the pivot 32*c* by an air cylinder (not shown) at the back of the base 40. The entire frame 32 is cantilevered from and movable vertically in its horizontal orientation on ball bushings that move on two vertical guide rods within the oven posts 44, 46 by an air cylinder (not shown). The film frame 32 can be moved vertically upward to a position adjacent and below the oven 30 for heating the film clamped in the frame, and downward to the vacuum platen 28 for application of the film to a packaging panel and products on the panel, supported on the vacuum platen. A channel 56, open at the bottom and extending transversely at the distal end of the upper frame member 32*b*, straddles the path of a moveable cutter 58 (FIG. 2) when the frame is closed. The cutter is moveable across the top support surface 42 of the base 40 to sever film from a preceeding package on the take-off conveyor 26**.

A bridge roll 60 adjacent the discharge end of the vacuum platen 28 extends across the path of the package movement between the platen and the take-off conveyor, between the base 40 and the take-off conveyor 26. The roll serves to support a package as it moves from the platen to the take-off conveyor. Pinch rolls 62 at the receiving end of the take-off conveyor, adjacent the platen, receive a leading end of a completed package and are driven to drawn the package from the platen and propel it onto the take-off conveyor. A lower roll **62*a* extends the full width of the vacuum platen to support and engage the bottom surface of a package panel. Two upper rolls 62*b*, 62*c*, one adjacent each end of the lower roll 62*a*, are relatively short, to pinch only the longitudinally extending marginal edges of the top surface of the package so the packaged products can pass between the upper pinch rolls. Idler rolls 64** downstream from the pinch rolls receive the package and support it for removal.

Figure 3:
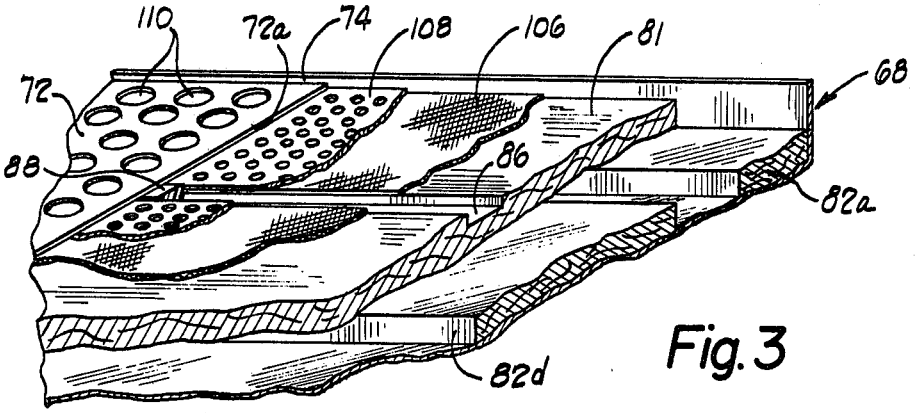
FIG. 3 is an isometric partial view, with parts broken away and in section, of the vacuum platen of FIG. 2.
Figure 4:
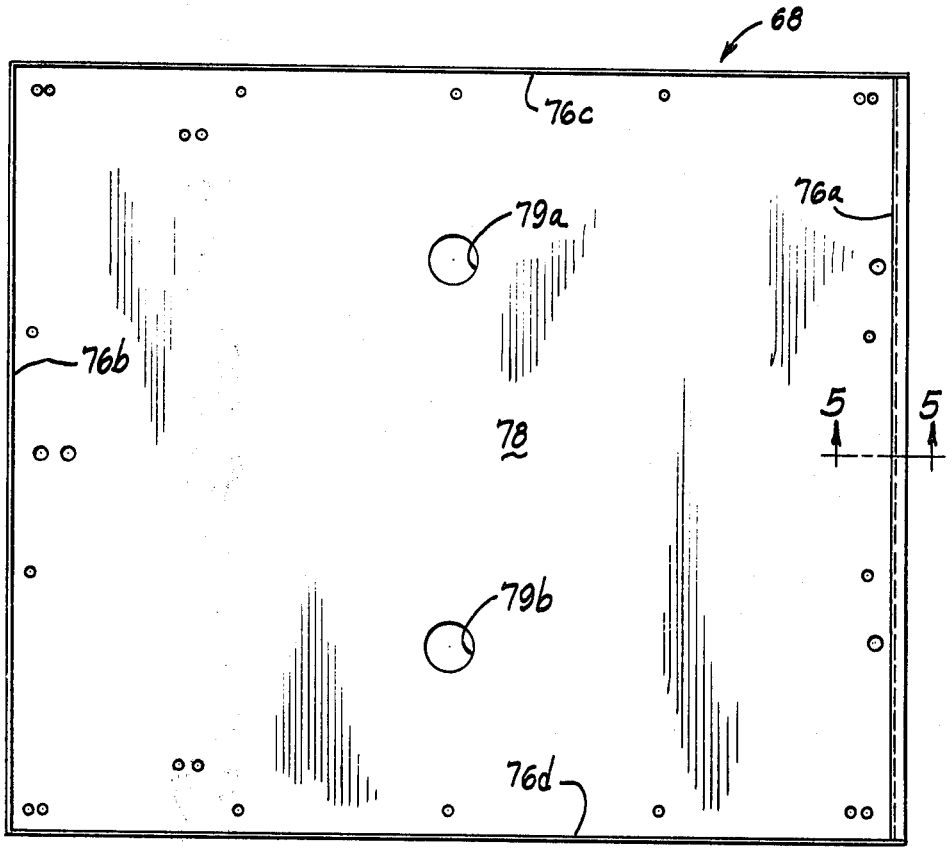
FIG. 4 is a top plan view of a box member forming a part of the vacuum platen.
Figure 5:
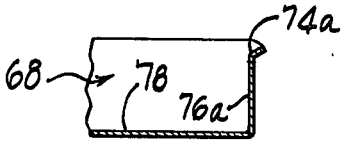
FIG. 5 is a partial sectional view taken along the line 5—5 of FIG. 4.
Figure 6:
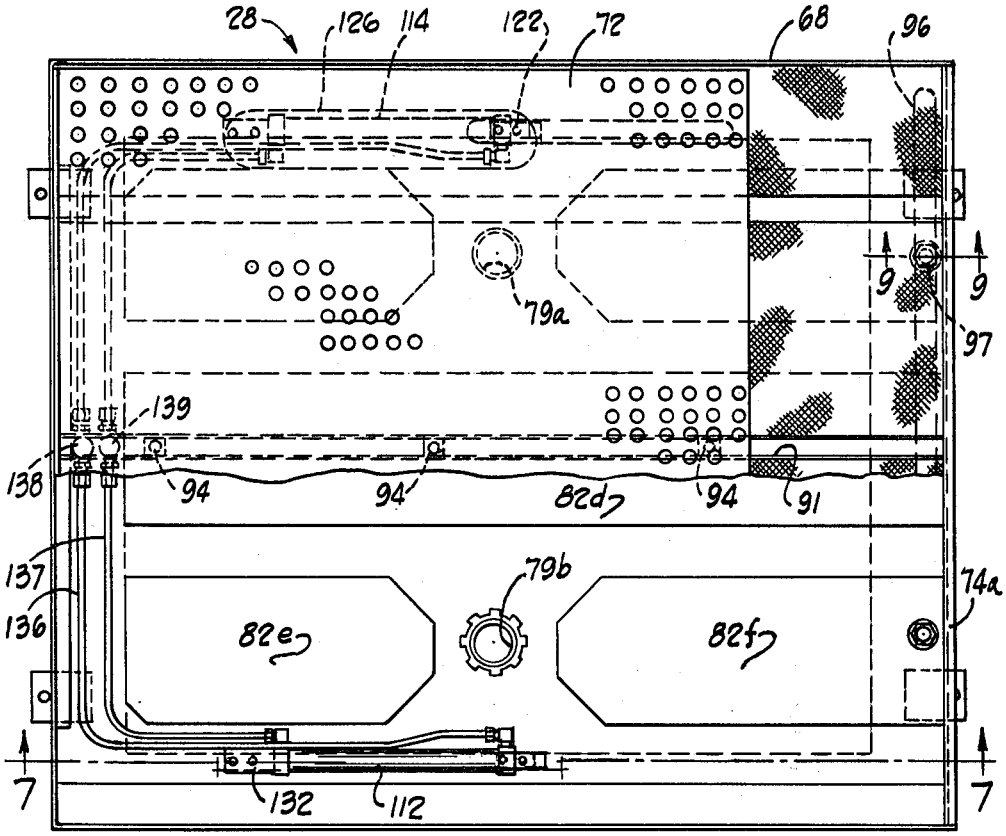
FIG. 6 is a top plan view with parts broken away of the vacuum box of FIG. 2.
Figure 7:
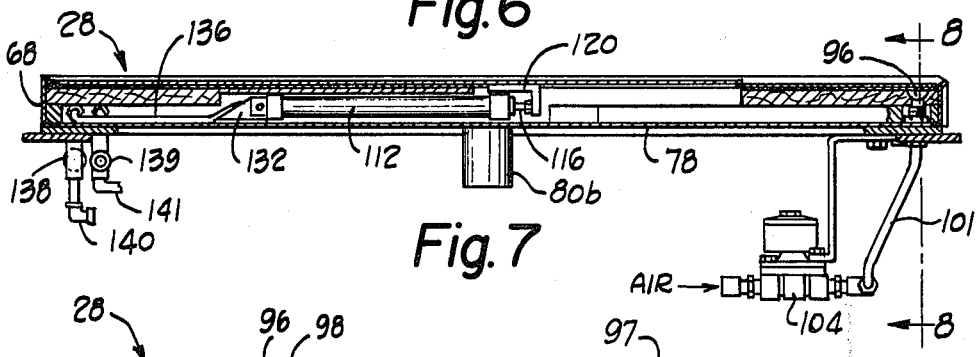
FIG. 7 is a sectional view taken along the line 7—7 of FIG. 6.

The vacuum platen 28, as shown in detail in FIGS. 2–12, includes a rectangular pan or box 68, a gas permeable top surface 70 and a gas permeable package discharge plate 72 slidable within the box over the surface 70. The box is suitably of metal, with a top edge 74 that extends slightly above the bottom member **32*a* of the film frame 32 when the frame is in a lowered position, as best shown in FIG. 2. As shown in FIG. 4, the box has four sidewalls 76***a–d* and a bottom 78. A portion 74*a* of the top edge of the box forms the upper edge of the box side 76*a* and is inclined outwardly as shown in FIG. 5 to facilitate removal of a package from the front side of the platen. As illustrated in FIG. 2, the box 68 is of the size and shape closely surrounded by the lower frame member 32*a*. It is also of a size and shape substantially equal to the packaging panel to be received on the platen within the top edge 74. Two openings 79*a*, 79*b* in the bottom 78 of the box communicate to a vacuum pump through conduits 80*a*, 80*b*.

The volume within the box 68 is reduced by internal structure, illustrated in FIG. 3, which includes two plywood layers formed by a top board 81 (FIGS. 3–10, and 11) and filler blocks 82*a–h* (FIGS. 3 and 12) that are spaced to define channels between the top board and the bottom 78 of the box. Apertures 84 through the top board are in communication with the channels, so that air is withdrawn at a number of spaced openings adjacent the top surface 70 of the platen, without requiring evacuation of the entire volume otherwise represented by the volume of the box or pan 68. As a result, the ability to draw a vacuum quickly and efficiently is enhanced.

The top board 81 has two parallel, spaced, shallow, narrow grooves 86, 87 (FIGS. 3, 10 and 11) that extend the length of the board in the direction of package travel along the platen from the loading table to the take-off conveyor. A nylon insert or runner 88 is received in each groove 86, 87 and extends slightly above the top board to support the bottom of the movable discharge plate 72. Also, a central groove 90 parallel to and between the two grooves 86, 87 is formed in the top board and receives a metal channel 91 that receives blocks 94 (FIG. 6) on the bottom surface of the discharge plate 72. By virtue of a relatively close fit between the blocks and channel, the plate 72 is guided in a rectilinear path of movement forward and back on the vacuum platen.

Figure 8:
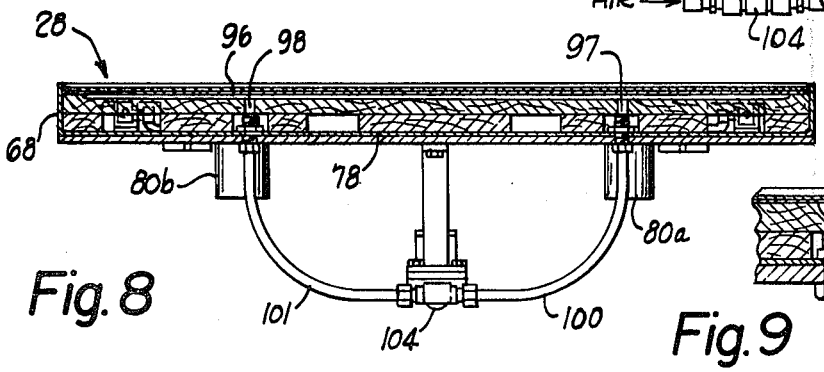
FIG. 8 is a sectional view taken along the line 8—8 of FIG. 7.
Figure 9:
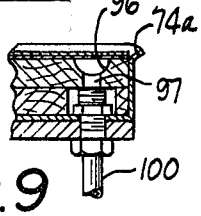
FIG. 9 is a partial sectional view taken along the line 9—9 of FIG. 6.
Figure 10:
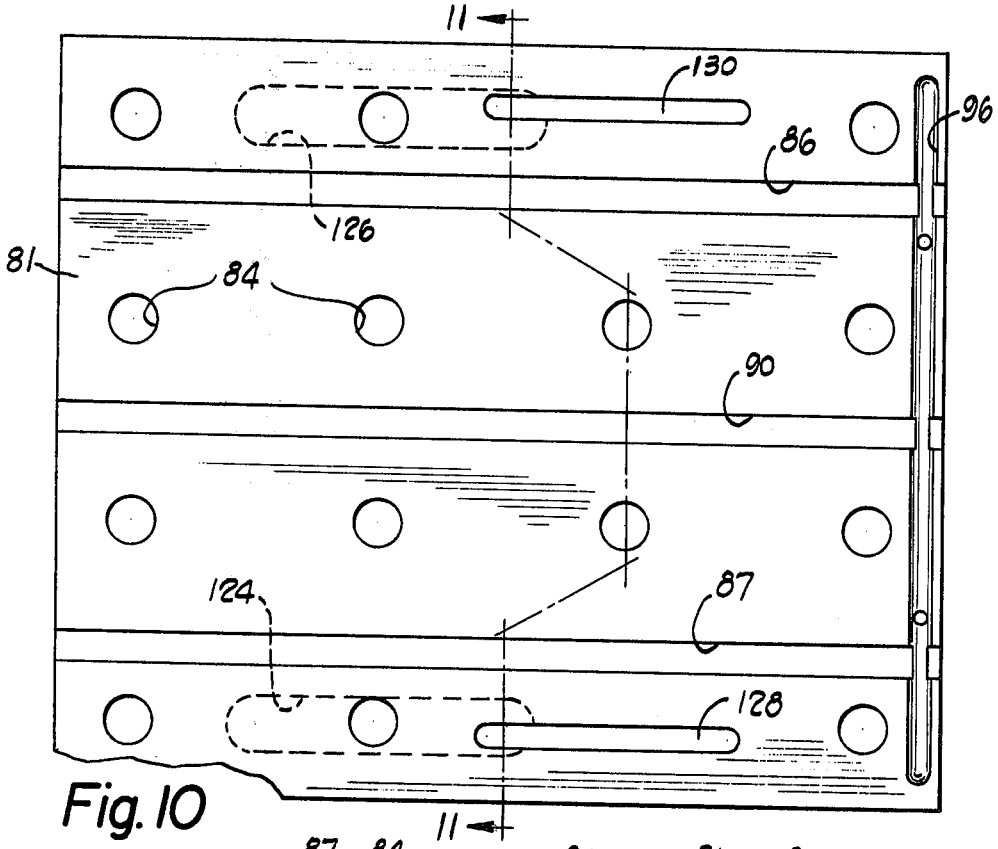
FIG. 10 is a top plan view of an upper board forming a part of the platen of FIG. 2.
Figure 11:
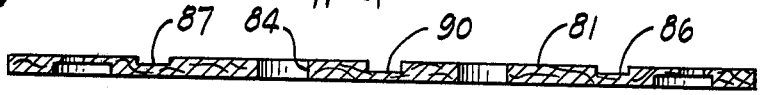
FIG. 11 is a sectional view taken along the line 11—11 of FIG. 10.
Figure 12:
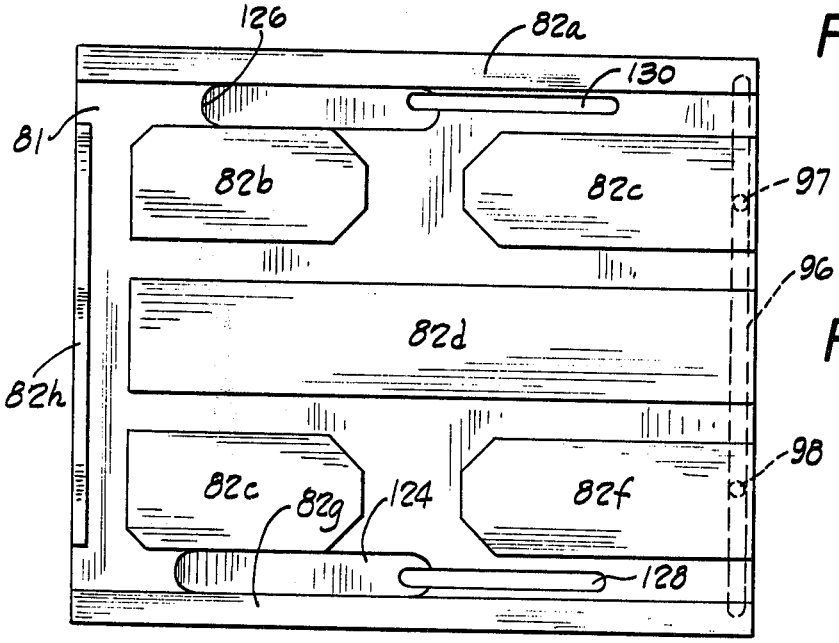
FIG. 12 is a bottom plan view of the upper board of FIG. 10 with filler boards on the bottom surface.

As best shown in FIGS. 8–10, a narrow groove 96 is milled in the top surface of the top board 81, substantially across the width of the board in a direction transverse to the direction of travel of the discharge plate 72, and is located closely adjacent to discharge edge or lip 74*a* of the box 68. Two apertures 97, 98 open into the bottom of the groove, and two conduits 100, 101 extend from a solenoid operated control valve 104 through the bottom 78 of the box 68 and through the filler blocks 82*c,f*, where they communicate with the apertures. The solenoid operated control valve 104 connects the conduit to a source of air under pressure. By virtue of this construction, the groove is isolated from the low pressure conduits of the vacuum box and serves as a plenum of pressurized air when the solenoid-operated control valve 104 is opened.

Two layers of air-permeable support material overlie the top board 81 to form the top surface of the vacuum platen. A first layer is comprised of four pieces of mesh screen 106 (FIG. 3), each piece extending the length of the platen and being spaced from one another transversely by the nylon runners 88 and the channel 91. A top layer is similarly formed of porous or finely perforated metal sheet 108. The mesh screen and porous metal sheets provide paths beneath a supported package or packaging panel through which air can be withdrawn from above the permeable packaging panel into the vacuum box and thence to the vacuum pump.

Figure 13:
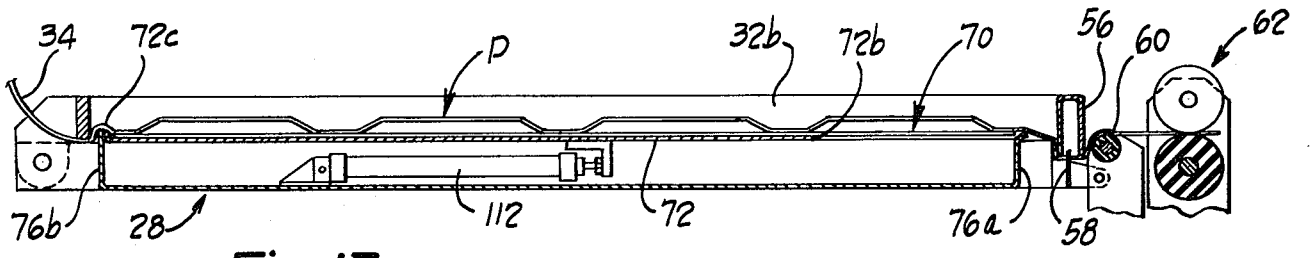
FIGS. 13 and 14 are diagrammatic longitudinal sectional views of the vacuum platen of FIG. 2 illustrating two positions of a discharge plate and a supported package.

The perforated discharge plate 72 is supported over the porous metal sheet 108 by the nylon inserts or runners 88 to reduce frictional resistance and wear. The plate 72 extends esentially the full width of the vacuum platen but is significantly shorter. A front edge 72*a* is spaced from the front wall 76*a* of the box 76 when a back edge 72*b* formed by an upturned flange 72*c* of the plate is against the back wall 76*b* of the box 76. The length of the discharge plate 72 is between 50 and 90 percent that of the platen surface, the exact amount over 50% depending upon the location of the pinch rolls 62. In the preferred embodiment shown, it is approximately 70 percent. Apertures 110, substantially larger than the smaller apertures of the porous metal sheet 108, permit air flow through the support so the vacuum drawn through the platen will draw air through the discharge plate and a package supported thereby. For example, 3/16 inch diameter holes on 5/16 inch centers are suitable in a 16 gauge metal sheet. To facilitate moving a packaging panel and articles onto the vacuum platen, the upturned flange portion of 72*c* extends no higher than the top edge 74 of the platen box, approximately ¼ inch in one preferred embodiment. By virtue of the shorter length of the discharge plate 72 relative to the platen, it can slide between a rear position as shown in FIG. 13 and a forward position shown in FIG. 14 to advance a package the same distance. The plate is moved from beneath its surface and from within the vacuum platen by two air cylinders 112, 114 (FIGS. 6 and 7) located within the box 68, one adjacent each sidewall 76*c*, 76*d* and extending in the direction of package movement along the platen. Each air cylinder has a piston rod (the rod 116 of cylinder 112 being shown in the drawings) that carries a bracket 120, 122 secured to the underside of the discharge plate 72. The cylinders are partially received within cavaties 124, 126 (FIG. 12) in the underside of the top board 81, and the brackets 20, 22 move in slots 128, 130 in the top board. The rear end of each cylinder is secured by a suitable end bracket 132, 134 to the bottom 78 of the box 68. Supply and exhaust conduits 136, 137 (FIGS. 5 and 6) connected to opposite ends of each of the two cylinders extend within the box to couplings 138, 139 at the bottom of the box, which communicate through the bottom of the box adjacent the back wall to exterior conduits 140, 141. The exterior conduits connect selectively with a source of air under pressure through a solenoid operated reversing valve. The stroke of each cylinder 112, 114 is equal to the difference in length between the discharge plate 72 and the vacuum platen, which is slightly more than the distance between the leading edge of the packaging panel and the point of tangency between the pinch rolls.

Figure 14:
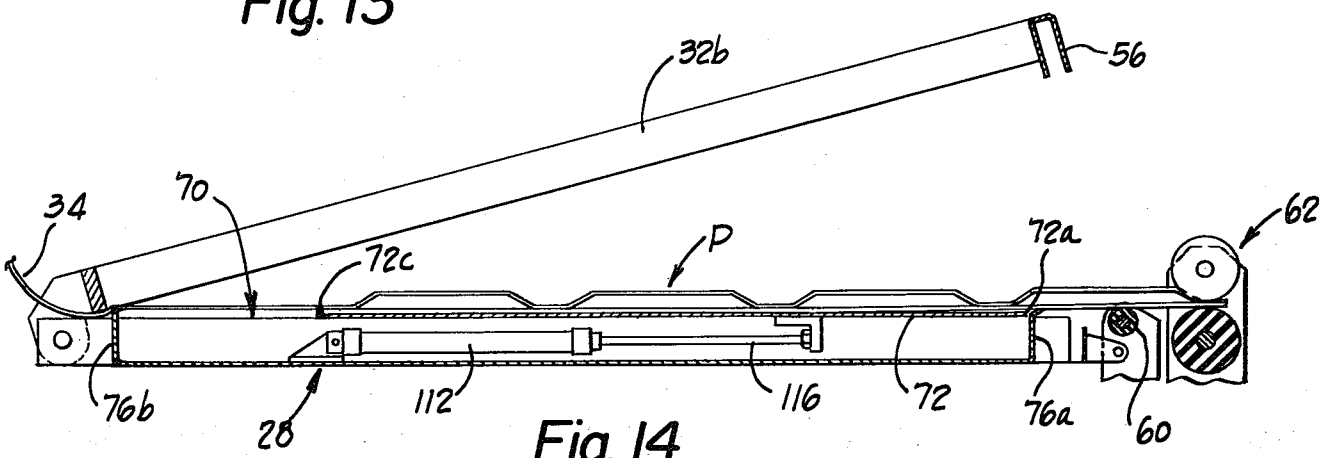

The manner in which a package P is ejected from the platen is illustrated in FIGS. 13 and 14. During the cycles of the packaging machine during which the film is being heated and applied to the support panel and products are packaged, the piston rods of the cylinders are withdrawn and the discharge plate 72 remains in the rear position shown in FIG. 13 underlying a major portion (70 percent in the embodiment shown) of the package. The front edge 72*a* is spaced from the front wall 76*a* of the vacuum box. When a vacuum is drawn through the vacuum platen, air from beneath the packaging film on the package panel is readily withdrawn through the platen and discharge plate. Upon completion of the package formation and post cooling, the frame 32 is opened and air is blown through the apertures 97, 98 into the groove 96 along the front edge of the vacuum platen. This flow of air creates positive pressure beneath and across the front edge of the package panel supported on the platen, breaking the vacuum beneath the package at least in the front area of the platen. Very little air flow is required to accomplish this because of the small volume of the groove 96. The discharge plate 72 is then advanced to the forward position shown in FIG. 14 by actuation of the air cylinders 112, 114 to extend the piston rods. This advances the supported package because the upturned back edge or flange 72*c* of the plate prevents relative sliding between the package and plate. Because the plate supports more than half of the package area, the package is substantially carried rather than entirely slid on the platen and any tendency of the package to stick or buckle or become skewed in its travel is substantially reduced or essentially eliminated.

Upon initial movement of the support plate, the front edge of the package slides up and over the inclined lip 74*a* of the box 68 and the plate 72 moves along the platen a distance equal to the distance from the lip 74*a* to the pinch rolls 62. Operation of the pinch rolls then pulls the package the remaining distance from the platen and deposits it on the idler rolls of the take-off conveyor 26. Rotation of the pinch rolls is started when the leading edge of the package advances beyond the vacuum box. When the pinch rolls have moved the package to a location where the trailing edge is beyond the vacuum platen, a photo eye senses the end of the package and stops rotation of the pinch rolls. The upper film frame 32*d* is then closed to clamp the film that was drawn into the frame by the advancing package P for the next cycle. The cutter 58 is then actuated to sever the film from the trailing edge of the package. Upon completion of this cutting operation, the drive of the pinch rolls is reestablished to advance the package from the pinch rolls completely onto the take-off conveyor. The film frame 32 is then lifted about 4 inches or more from the platen unless a next cycle is immediately initiated, in order to prevent heating and softening of the film from residual platen heat.

While it is intended that the panel forming the package P conform to the platen size, shorter panels than the platen can be used, but must be positioned to abut the front wall 76*a* of the box 68 and must overlie enough of the discharge plate to be adequately supported for movement; i.e., the panel should overlie one-half or more of the discharge plate. A separate abutment, such as a strip can be attached to the discharge plate at the appropriate location to abut the back edge of the panel when the plate is at its rearward position, or spacers can be placed on the plate between the rear flange 72*c* of the plate and the back edge of the package panel to prevent relative movement between the plate and panel when the plate is moved to a forward position.

While a preferred embodiment of the invention has been described in detail, it will be appreciated that modifications and alterations may be made therein without departing from the spirit and scope of the invention set forth in the appended claims.

I claim:

1. In apparatus for film packaging comprising a vacuum platen, a film supportig frame, the platen and frame being relatively movable toward and away from each other, means for heating film supported by the frame, and means for drawing a vacuum through the platen, the improvement comprising a plate on the platen constructed to support a major portion of a package on the platen and slidable in a forward and back direction on the platen, the plate having a length in the direction of sliding motion greater than half the length of the platen and less than the full length and having an abutment for engaging a package and moving the package relative to the platen, said plate being constructed and arranged to permit flow of gas through the plate to the underlying platen, and means to slide the plate relative to the platen.

2. Apparatus as defined in claim 1 wherein the means for drawing a vacuum through the platen includes a vacuum box beneath the platen and the platen includes an opening beneath the plate elongated in the forward and back direction, and the means to slide the plate relative to the platen includes powered drive means within the vacuum box connected to the plate through said opening.

3. In apparatus for film packaging comprising a vacuum platen that at least in part directly supports a package and means for drawing a vacuum through the platen, the improvement comprising means including an air-permeable plate slidable on the platen to partially underlie, engage and move a package from the platen, and means only at an end of the platen from which the package is removed to establish a localized fluid pressure beneath and along one edge of the package that is directly supported by the platen to at least in part release the package from the platen.

4. In apparatus for film packaging comprising a vacuum platen that at least in part directly supports a package, a film support, means for heating film and means for drawing a vacuum through the platen, the improvement comprising means movable in a direction across the platen for supporting a major portion of a package on the platen but not the entire package and for moving the package relative to the platen, means to remove a package from the platen, and means only at an end of the platen from which the package is removed to establish an increased localized fluid pressure beneath one edge of the package that is unsupported by the movable means to at least in part release the package from the platen.

5. In apparatus for film packaging comprising a vacuum platen, a film support, means for heating film and means for drawing a vacuum through the platen, the improvement comprising a plate on the platen constructed to support a major portion of a package on the platen and slidable in a forward and back direction on the platen, the plate having a length in the direction of sliding motion greater than half the length of the platen and less than the full length and having an abutment for engaging a package and moving the package relative to the platen, said platen being constructed and arranged to permit flow of gas through the plate to the underlying platen, means to slide the plate relative to the platen, and means at an end of the platen from which the package is removed to establish a localized fluid pressure adjacent one edge of the package to at least in part release the package from the platen.

6. An improved vacuum platen for a film packaging machine, comprising a gas-permeable support surface adapted to be in part directly covered by a panel used to form a package, a vacuum chamber beneath the surface, a plate slidably supported for movement along and directly over the support surface with openings through which gas can flow and having an abutment extending above an upper surface for engaging a trailing edge of a package, said plate being greater in length than one-half the length of the platen support surface and less than the full length, adapted to underlie part but not all of said panel with a portion of the panel extending beyond a forward edge of the plate, means associated with the platen for moving the plate and a supported panel in a forward direction along the platen support surface, and means beneath the platen and beyond the forward edge of the plate when the plate is in a back position to exert a lifting force away from the support surface only beyond the forward edge of the plate.

7. The vacuum platen as defined in claim 6 wherein said means for moving the plate is located within the vacuum chamber.

8. The vacuum platen as defined in claim 6 wherein the platen and plate are generally rectangular, the plate is of substantially the same dimensions as the platen in a direction transverse to the direction it is moved along the platen and wherein the means for moving the plate is constructed to move it no further than to an edge of the platen.

9. The vacuum platen as defined in claims 6, 7 or 8, wherein said means beneath the platen and beyond the forward edge of the plate includes means for supplying gas under pressure to the support surface only at locations adjacent and along one edge portion of the platen.

10. The vacuum platen as defined in claim 6 wherein the platen is generally rectangular and the plate moves in a forward direction to discharge a package from the platen over one edge of the platen, and the platen includes a small plenum beneath the support surface extending at least partially across the platen adjacent said one edge, and means to introduce gas under pressure to the plenum.

11. The vacuum platen as defined in claim 8 or 10 wherein the means for moving the plate includes a fluid-operated reciprocating actuator located within the vacuum chamber and connected through the gas-permeable support surface to the plate for reciprocating the plate.

12. The vacuum platen as defined in claim 6 including a channel in and along the platen support surface and a projection depending from the plate slidably received within the channel for guiding the plate movement.

13. An improved vacuum platen for a film packaging machine, comprising a vacuum box, an air-permeable package support surface over the box, a small elongated cavity beneath and opening to the support surface, said cavity located only along one edge of the box and support surface, means to selectively supply air under pressure to the cavity only along said one edge and an air-permeable plate partially overlying the platen and slidable thereon toward and away from said one edge.

14. A method of film packaging comprising the steps of providing a vacuum platen and film heater spaced vertically, and a film-carrying frame constructed to cooperate with the platen and move vertically between the platen and heater, gripping with the frame a portion of film from a continuous supply, moving the frame and film to a position adjacent the heater, heating the film, placing a panel and an article to be packaged on the platen with at least a portion of the panel including one edge supported directly on the platen and a portion supported on an air-permeable plate movable on the platen, lowering the frame to the platen and the heated film onto the article and panel, drawing a vacuum through the platen, releasing the film from the frame, emitting gas under the panel on the platen from a location only beneath said one edge, carrying the panel by moving said plate over the platen in a direction to advance the one edge off the platen, gripping said edge off the platen with pinch rolls and removing the panel from the platen to a location adjacent the platen while concurrently bringing fresh film connected to the panel to the frame, severing the film adjacent the panel, moving the panel from adjacent the frame, and raising the frame and film to a position slightly above the platen and maintaining it there until a subsequent packaging cycle is initiated.

15. In a method of film packaging, the steps of supporting more than half and less than all of the base area of a package on a movable air-permeable plate over a vacuum platen while forming the package, introducing air under pressure beneath an edge of the package not supported by the plate after the package is formed, and moving a portion of the package not supported by the plate from the platen by moving the plate along the platen.

16. In a method of film packaging, the steps of: substantially covering a vacuum platen with a panel on which products are to be secured with a plastic film; supporting less than all and more than half of the panel by a movable plate over the platen; and discharging the panel from the platen upon completion of a package by introducing air under pressure at a location only beneath the portion of the panel unsupported by the plate moving the plate along the platen a distance sufficient to move the portion of the panel unsupported by the plate off the platen and into the bite of pinch rolls, and pulling the package from the plate with the pinch rolls.

17. Film packaging apparatus comprising:

a vacuum platen and film heater spaced vertically, a film-carrying frame constructed to cooperate with the platen, moveable vertically between the platen and heater, said frame including means to selectively grip a portion of film from a continuous supply and to release the portion, means to move the frame and film between positions adjacent the heater and adjacent the platen, means to draw a vacuum through the platen, means to supply gas under pressure beneath a panel on the platen only adjacent one edge of the panel, means underlying only a portion of the panel that excludes said one edge to carry the panel over the platen in a direction to advance said one edge off the platen, means including pinch rolls adjacent the platen to grip said edge and remove the panel from the platen to a location adjacent the platen and to concurrently bring fresh film connected to the panel to the frame, and means to sever the film adjacent the panel.

* * * * *